US007467902B2

(12) United States Patent
Ono

(10) Patent No.: US 7,467,902 B2
(45) Date of Patent: Dec. 23, 2008

(54) ROTATIONAL TORQUE ADJUSTMENT APPARATUS, INK RIBBON TRANSPORT APPARATUS AND PRINTER

(75) Inventor: Katsuhisa Ono, Tokyo (JP)

(73) Assignee: Sony Corporation, Tokyo (JP)

( * ) Notice: Subject to any disclaimer, the term of this patent is extended or adjusted under 35 U.S.C. 154(b) by 465 days.

(21) Appl. No.: 11/401,636

(22) Filed: Apr. 11, 2006

(65) Prior Publication Data

US 2006/0233583 A1 Oct. 19, 2006

(30) Foreign Application Priority Data

Apr. 13, 2005 (JP) ..... P2005-115362

(51) Int. Cl.
*B41J 33/52* (2006.01)

(52) U.S. Cl. ..... 400/234; 400/223; 242/334.5; 242/343

(58) Field of Classification Search ..... 400/223, 400/234; *B41J 33/52*
See application file for complete search history.

(56) References Cited

U.S. PATENT DOCUMENTS 5,051,011 A * 9/1991 Satoh et al. ..... 400/219
6,799,913 B2 * 10/2004 Ono et al. ..... 400/223

* cited by examiner

*Primary Examiner*—Leslie J Evanisko
(74) *Attorney, Agent, or Firm*—Rockey, Depke & Lyons, LLC; Robert J. Depke

(57) ABSTRACT

A rotational torque adjustment apparatus is used to adjust the rotational torque of a rotational member secured to a rotational shaft for integrally rotating with the rotational shaft. The rotational torque adjustment apparatus includes a friction member for contacting with the rotational member to apply a frictional load to the rotational member, a brake member for holding the frictional member thereon, a pressing member for pressing the friction member held on the brake member with a predetermined pressure against the rotational member, and a guide section for holding the brake member for movement thereon. The brake member is moved in a radial direction of the rotational member along the guide section to vary the rotational torque of the rotational member.

10 Claims, 9 Drawing Sheets

ROTATIONAL TORQUE ADJUSTMENT APPARATUS, INK RIBBON TRANSPORT APPARATUS AND PRINTER

CROSS REFERENCES TO RELATED APPLICATIONS

The present invention contains subject matter related to Japanese Patent Application P2005-115362 filed with the Japanese Patent Office on Apr. 13, 2005, the entire contents of which being incorporated herein by reference.

BACKGROUND OF THE INVENTION

This invention relates to a rotational torque adjustment apparatus for adjusting the rotational torque of a rotational member which rotates integrally with a rotational shaft, an ink ribbon transport apparatus wherein a rotational torque adjustment apparatus is used to supply an ink ribbon and a printer in which an ink ribbon transport apparatus is used.

Conventionally, in a printer in which an ink ribbon is used such as a sublimatic printer or a thermal transfer printer, if the ink ribbon becomes slackened upon printing, then a wrinkle may appear with the ink ribbon and give rise to a failure in printing. Therefore, generally back tension is applied to the ink ribbon to be fed out from the supply roll to prevent slackening of the ink ribbon.

Further, also on the takeup spool side, the takeup force is adjusted taking the back tension into consideration. Thus, the tension of the ribbon is controlled to a fixed level between the supply spool and the takeup spool.

Various measures are applied to the application of the ribbon tension, and measures which include a brake mechanism which includes a torque clutch, a torque limiter or a like element for each of the spools and different measures which use such a resilient member as, for example, a leaf spring or a like element are adopted principally.

However, as the winding diameter of the ink ribbon wound on the supply spool and the winding diameter of the ink ribbon taken up on the takeup spool gradually vary as printing proceeds, the torque applied to each of the spools varies. Therefore, various techniques have been proposed in order to apply a fixed level of ribbon tension to the ink ribbon.

For example, Japanese Patent Laid-Open No. 2002-234241 disclosed an apparatus wherein the rotational torque of a shaft for driving the takeup spool is determined by the clamping pressure of a clamping member and a spring compressing gear held in meshing engagement with the shaft is rotated to change the spring biasing force to the clamping member so as to adjust the rotational torque in response to the winding diameter of the ink ribbon.

Japanese Patent Laid-Open No. Hei 6-316139discloses another apparatus wherein the number of pulses generated in response to rotation of each of the takeup spool and the supply spool is counted and a motor voltage with which motor torque and a rotational speed suitable for the winding diameter of the ink ribbon is implemented is arithmetically operated to control the motor.

However, with the apparatus of Japanese Patent Laid-Open No. 2002-234241 described above, every time adjustment is to be performed, the compressing gear must be rotated to perform setting. Therefore, the apparatus has a disadvantage that much time is required for the setting.

Meanwhile, the apparatus of Japanese Patent Laid-Open No. Hei 6-316139 is disadvantageous in that the control is complicated and a mechanical system suffers from a dispersion caused by differences among different apparatus, resulting in the possibility that the stability in feeding of the ink ribbon may be degraded.

SUMMARY OF THE INVENTION

In the present invention, it is desirable to provide a rotational torque adjustment apparatus, an ink ribbon transport apparatus and a printer by which stabilized rotational torque for a rotational member can be obtained at a low cost.

In order to attain the desire described above, according to the present invention, there is provided a rotational torque adjustment apparatus for adjusting rotational torque of a rotational member secured to a rotational shaft for integrally rotating with the rotational shaft, including a friction member for contacting with the rotational member to apply a frictional load to the rotational member, a brake member for holding the frictional member thereon, a pressing member for pressing the friction member held on the brake member with a predetermined pressure against the rotational member, and a guide section for holding the brake member for movement thereon, the brake member being moved in a radial direction of the rotational member along the guide section to vary the rotational torque of the rotational member.

In the rotational torque adjustment apparatus, the friction member held by the brake member contacts with the rotational member to apply a friction load to the rotational member. Then, the brake member moves in a radial direction of the rotational member.

Consequently, a plurality of different levels of rotational torque can be obtained by adjusting the contacting position of the friction member with the rotational member in the radial direction.

The above and other objects, features and advantages of the present invention will become apparent from the following description and the appended claims, taken in conjunction with the accompanying drawings in which like parts or elements denoted by like reference symbols.

DETAILED DESCRIPTION OF THE PREFERRED EMBODIMENT

Figure 1:
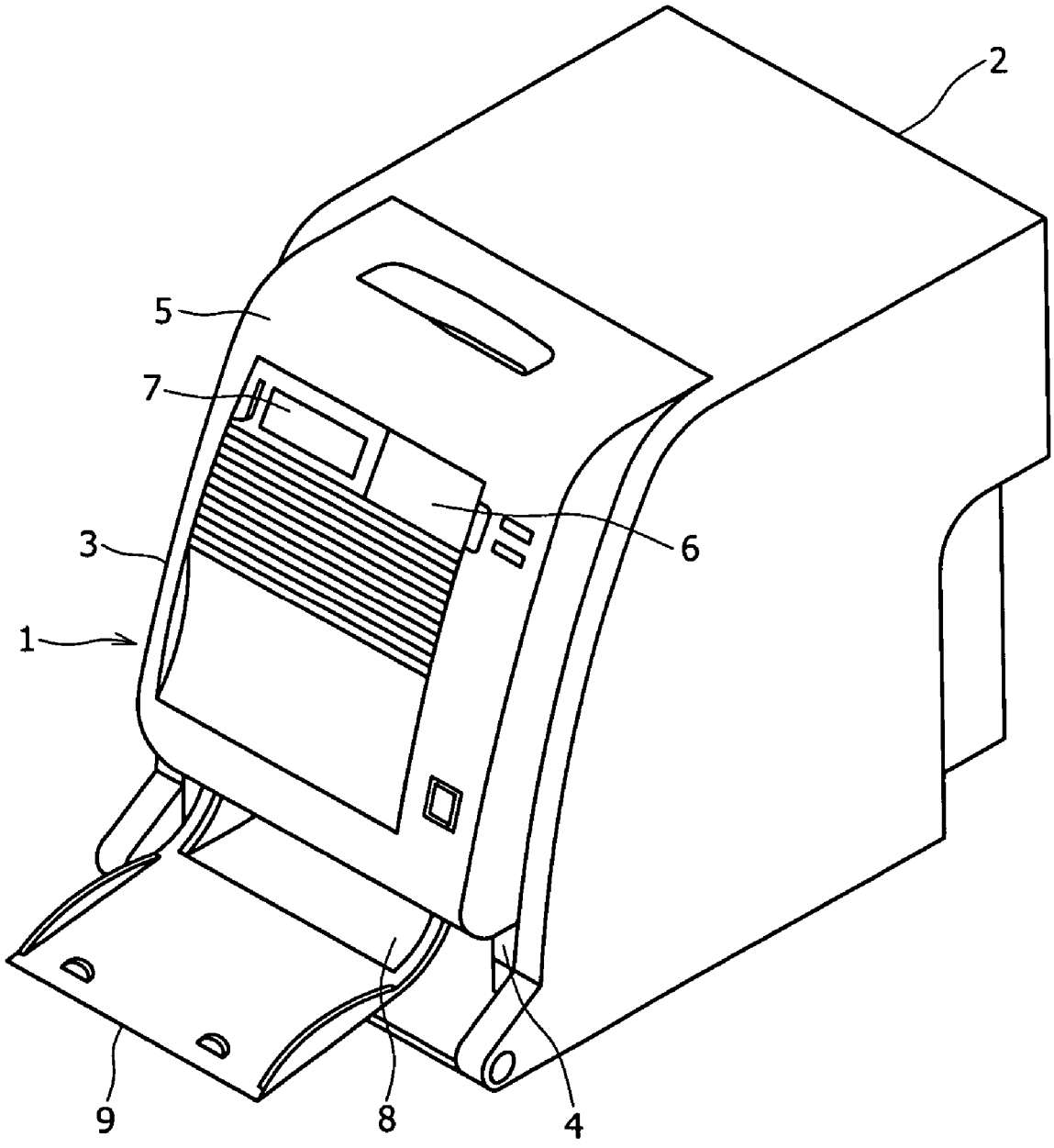
FIG. 1 is a perspective view showing an appearance of a printer to which the present invention is applied.

In a preferred embodiment of the present invention described below, a rotational shaft 21 functions as a rotational shaft; a rotational plate 22 (22A to 22B) functions as a rotational member; a friction member 23 (23A to 23D) function as a friction member; a brake plate 24 (24A to 24C) functions as a brake member; a pressing plate 25 and a pressing biasing member 26 function as a pressing member; and a guide member 27 and a guide biasing member 28 function as a guide member.

The embodiment of the present invention is described below with reference to the drawings.

It is to be noted that the rotational torque adjustment apparatus according to the present invention is applied to an ink ribbon transport apparatus, which is in turn incorporated in a printer.

Referring first to FIG. 1, there is shown an appearance of a printer 1 to which the present invention is applied. The printer 1 includes a housing section 2 and a door section 3 attached to the front face of the housing section 2. A power supply switch 4 is provided on the front face side of the housing section 2. Further, a door panel 5 is attached to the door section 3, and an operation panel 6 having various switches and a liquid crystal display panel 7 for displaying various messages thereon are provided on the front face of the door panel 5. Furthermore, a discharged paper tray 9 having a paper outlet 8 is attached to a lower end portion of the door section 3.

Figure 2:
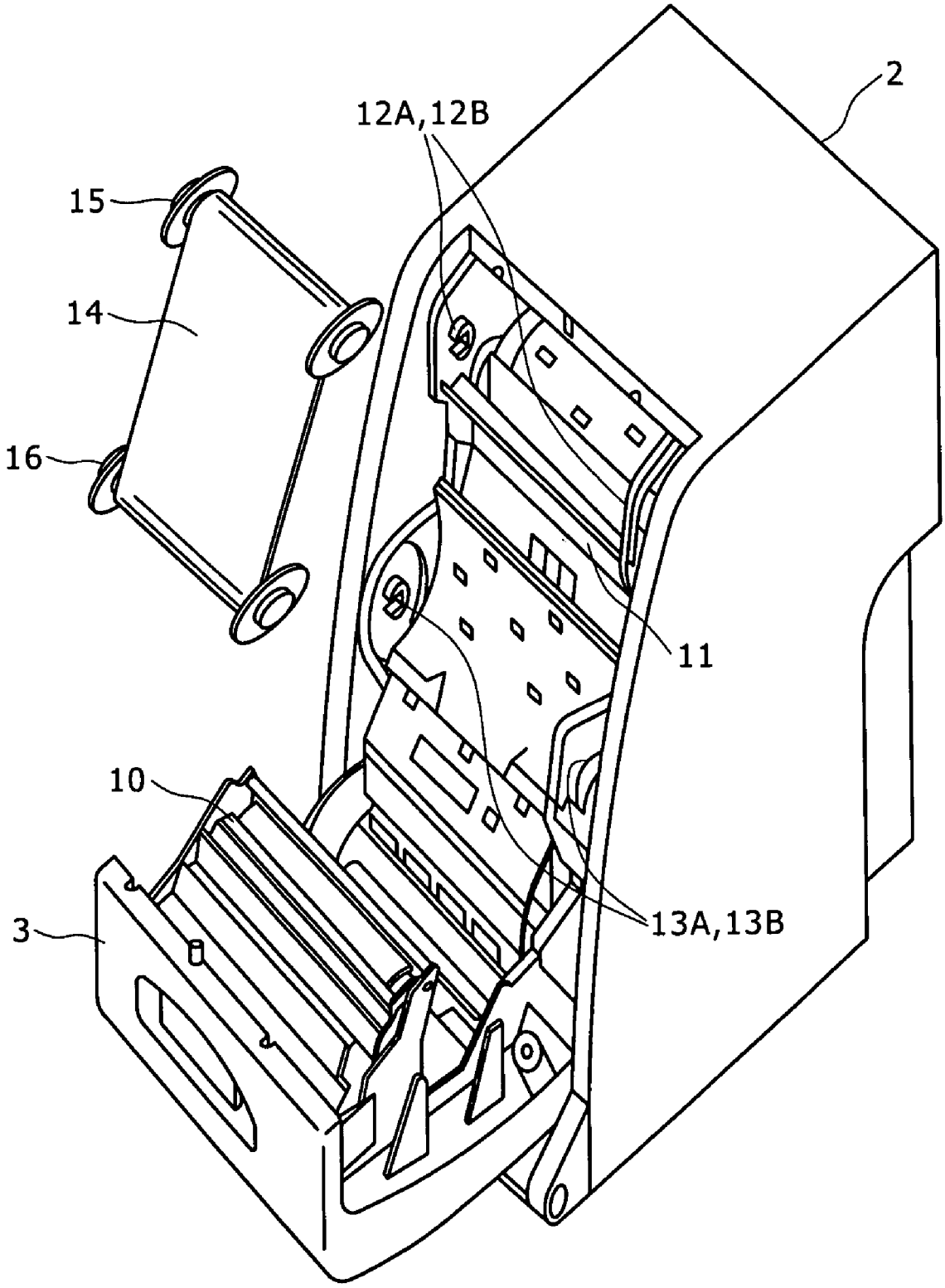
FIG. 2 is a schematic view showing an appearance of the printer of FIG. 1 where a door section is open.

Referring now to FIG. 2, there is shown an appearance of the printer 1 in a state wherein the door section 3 is open. FIG. 2 particularly shows an ink ribbon 14, and a takeup spool 15 and a supply spool 16 provided on the opposite sides of the ink ribbon 14.

A thermal head 10 is mounted on the rear face side of the door section 3. Meanwhile, a platen 11 is disposed in the housing section 2 at a position at which the platen 11 opposes to the thermal head 10 when the door section 3 is closed. It is to be noted that, though not shown, a grip roller and a pinch roller for transporting roll paper are provided in the proximity of the platen 11.

In the inside of the housing section 2, takeup spool engaging portions (12A and 12B) for engaging with the takeup spool 15 are provided above the platen 11. Below the platen 11, supply spool engaging portions (13A and 13B) for engaging with the supply spool 16 are provided. When the takeup spool 15 is engaged with the takeup spool engaging portions 12A, 12B and the supply spool 16 is engaged with the supply spool engaging portions 13A, 13B the takeup spool 15 and the supply spool 16 are attached for rotation in parallel to the platen 11. The ink ribbon 14 is disposed such that it passes above the platen 11. When the door section 3 is closed, the ink ribbon 14 is disposed between the platen 11 and the thermal head 10.

Figure 3:
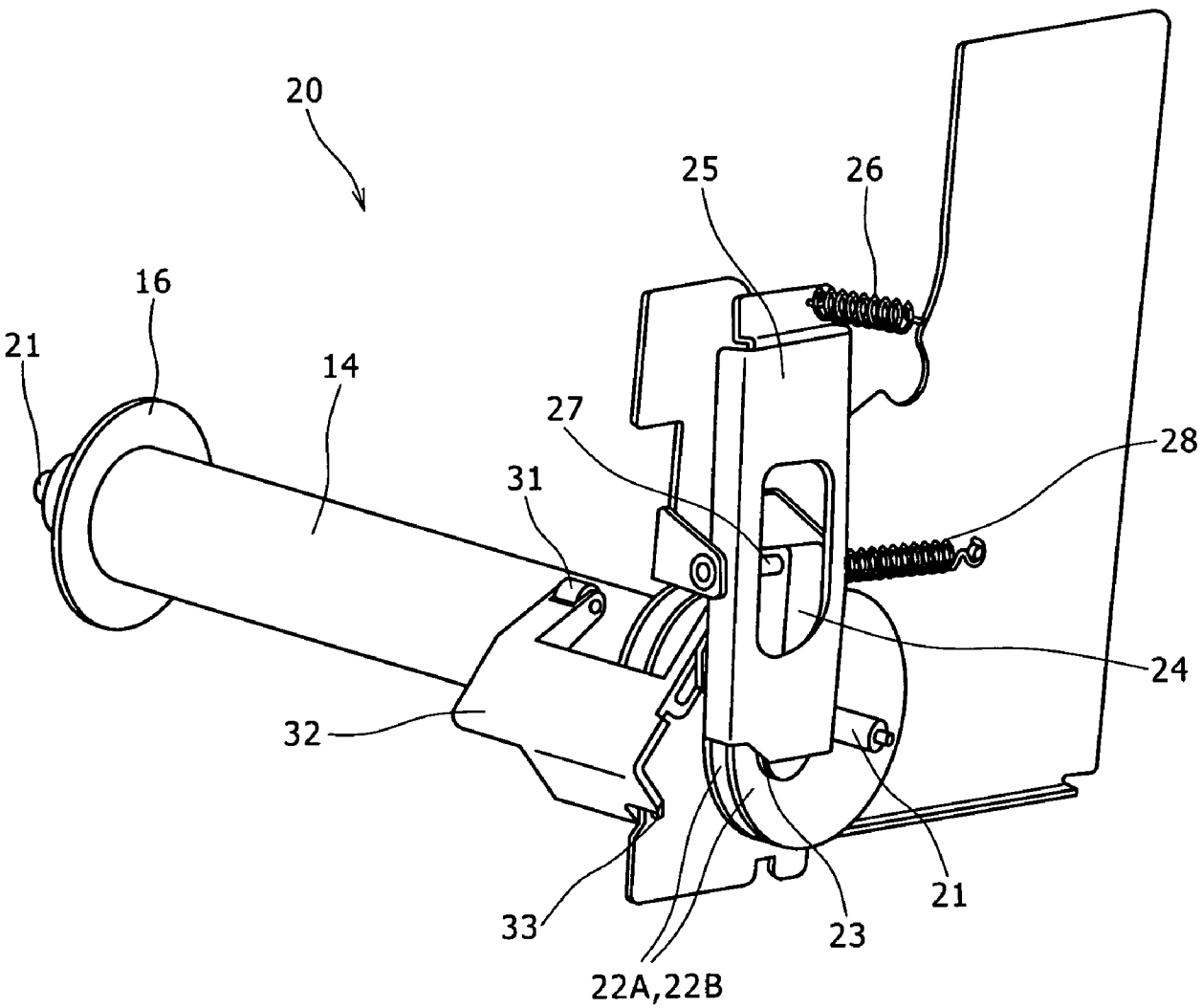
FIG. 3 is a perspective view showing an ink ribbon transport apparatus to which the present invention is applied.
Figure 4:
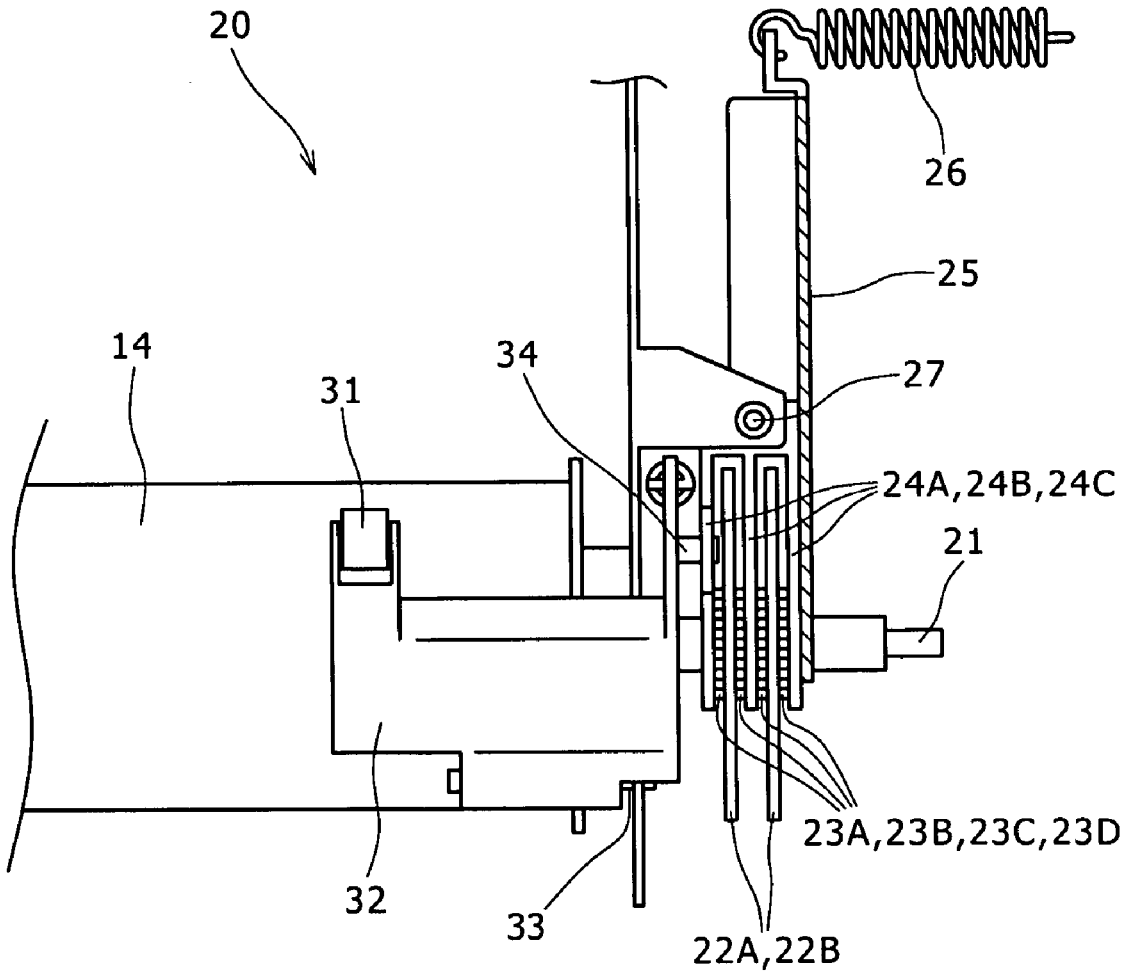
FIG. 4 is a plan view showing the ink ribbon transport apparatus of FIG. 3.

FIG. 3 shows an ink ribbon transport apparatus 20 to which the present invention is applied (ink ribbon transport apparatus 20 of the printer 1 of the present embodiment shown in FIG. 1). Meanwhile, FIG. 4 shows the ink ribbon transport apparatus 20 in plan. It is to be noted that a pressing plate 25 is partly broken so that rotational plates 22A and 22B, friction members 23A to 23D and brake plates 24A to 24C can be observed.

Referring to FIG. 3, the ink ribbon transport apparatus 20 includes a pair of rotational plates 22A and 22B mounted for integral rotation with a rotational shaft 21 of the supply spool 16. In particular, the rotational plates 22A and 22B are mounted coaxially with the rotational shaft 21 of the supply spool 16 for the ink ribbon 14 and rotate integrally with the ink ribbon 14 mounted on the printer 1 (refer to FIG. 1). The rotational plates 22A and 22B are made of a hard resin material which is easy in handling and superior in mass productivity and are each in the form of a disk having a thickness substantially uniform over the overall range thereof. The rotational plates 22A and 22B are provided in parallel to each other and spaced away from each other along the axial direction in order to sufficiently assure back tension hereinafter described to be applied to the ink ribbon 14.

Referring now to FIG. 4, three brake plates 24A to 24C are disposed on the opposite left and right sides of the rotational plates 22A and 22B. Further, a felt is adhered as a friction member 23A to 23D to each of the faces of the brake plates 24A to 24C which contact with the rotational plates 22A and 22B. The friction members 23A to 23D slidably contact with the rotational plates 22A and 22B without damaging the rotational plates 22A and 22B such that braking force is applied to the rotational shaft 21 of the supply spool 16 by frictional force of the friction members 23A to 23D. Therefore, load torque is applied to the rotational plates 22A and 22B, and consequently, back tension is applied to the ink ribbon 14.

Here, the frictional force generated by the brake plates 24A to 24C depends upon the pressing force of the friction members 23A to 23D which slidably contact with the rotational plates 22A and 22B and the coefficient of friction of the friction members 23A to 23D. In the ink ribbon transport apparatus 20, the pressing plate 25 is biased by a pressing biasing member 26 in the form of a tension spring and presses the brake plates 24A to 24C as seen in FIG. 4. It is to be noted that the pressing plate 25 is rockably moved around a guide member 27, and therefore, the tensile force of the pressing biasing member 26 serves as the pressing force upon the brake plates 24A to 24C.

In particular, referring to FIG. 4, where the left side rotational plate is the rotational plate 22A and the right side rotational plate is the rotational plate 22B and the friction members 23A to 23D and the brake plates 24A to 24C are arranged in order from the left side to the right side, the pressing plate 25 presses the surface (right side face) of the brake plate 24C in the leftward direction by action of the housing section 2. Therefore, the friction member 23D adhered to the brake plate 24C presses the right side face of the rotational plate 22B, and as a result, the left side face of the rotational plate 22B and the friction member 23C are contacted with each other. Accordingly, the rotational plate 22B is sandwiched from the opposite sides thereof by the friction member 23D and the friction member 23C.

Meanwhile, when the rotational plate 22B and the friction member 23C contact with each other, now the friction member 23B presses the right side face of the rotational plate 22A through the brake plate 24B to which the friction member 23C is adhered. Therefore, the left side face of the rotational plate 22A and the friction member 23A adhered to the brake plate 24A contact with each other. Accordingly, the rotational plate 22A is sandwiched from the opposite sides thereof by the friction member 23B and the friction member 23A.

In this manner, in the ink ribbon transport apparatus 20 shown in FIGS. 3 and 4, the three brake plates 24A to 24C sandwich the two rotational plates 22A and 22B with a fixed pressure through the friction members 23A to 23D, and the rotational plates 22A and 22B rotate while they always remain in contact with the friction members 23A to 23D. Therefore, frictional force corresponding to the tensile force of the pressing biasing member 26 acts upon the rotational plates 22A and 22B, and this acts as back tension to the ink ribbon 14.

Figure 5:
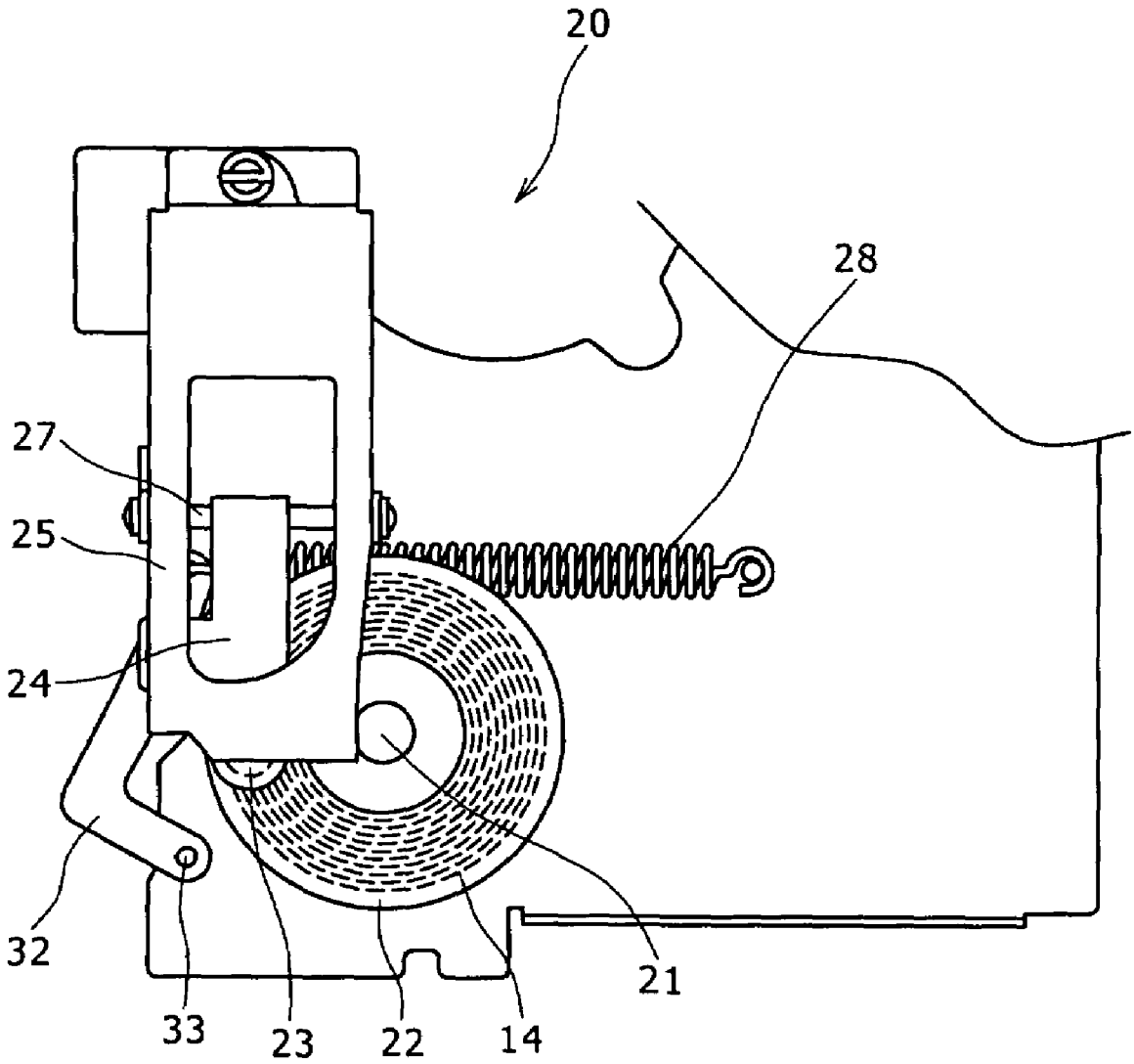
FIG. 5 is a side elevational view showing the ink ribbon transport apparatus of FIG. 3.
Figure 6:
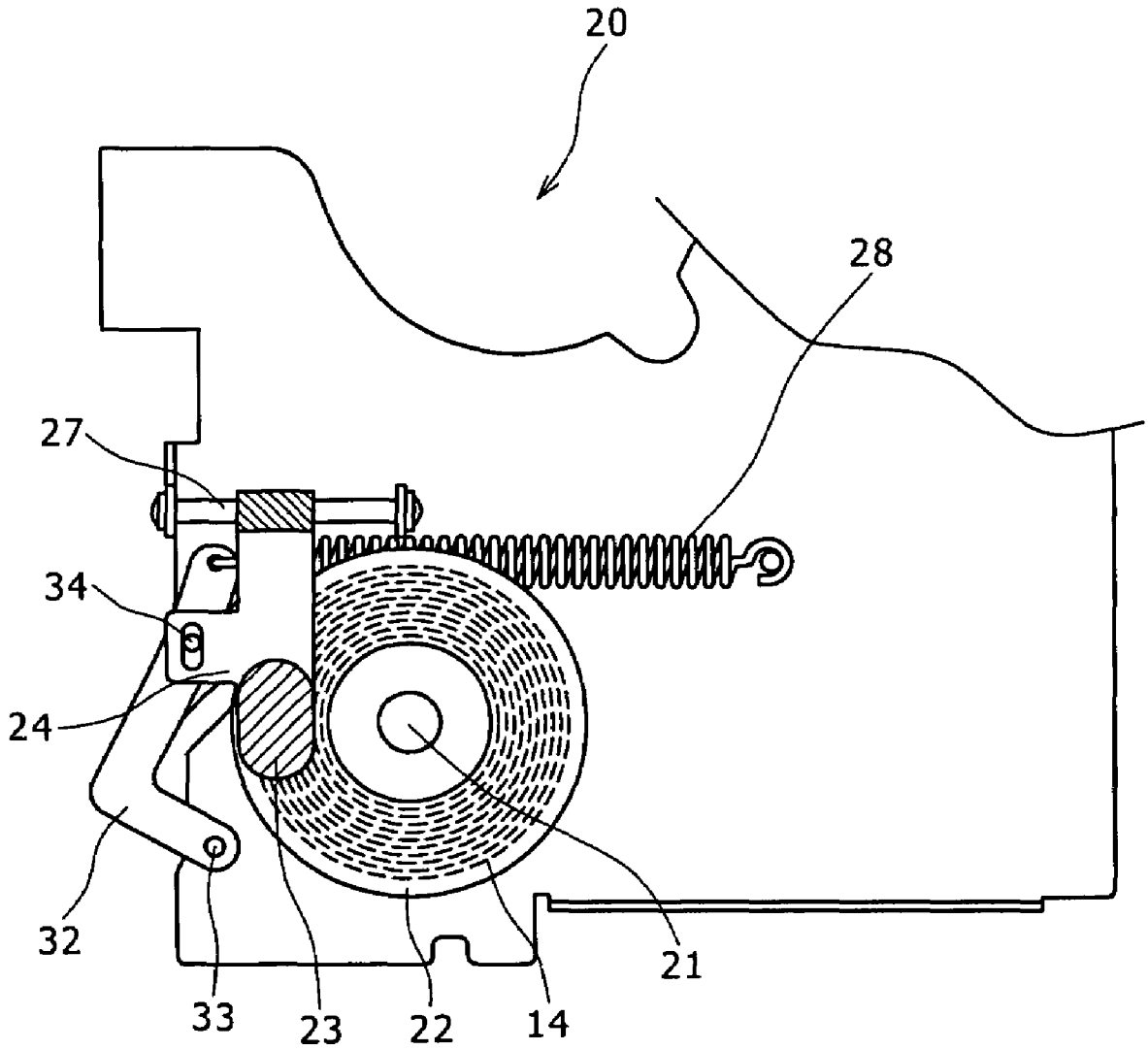
FIG. 6 is a side elevational view showing the ink ribbon transport apparatus of FIG. 3 with a pressing plate removed.
Figure 7:
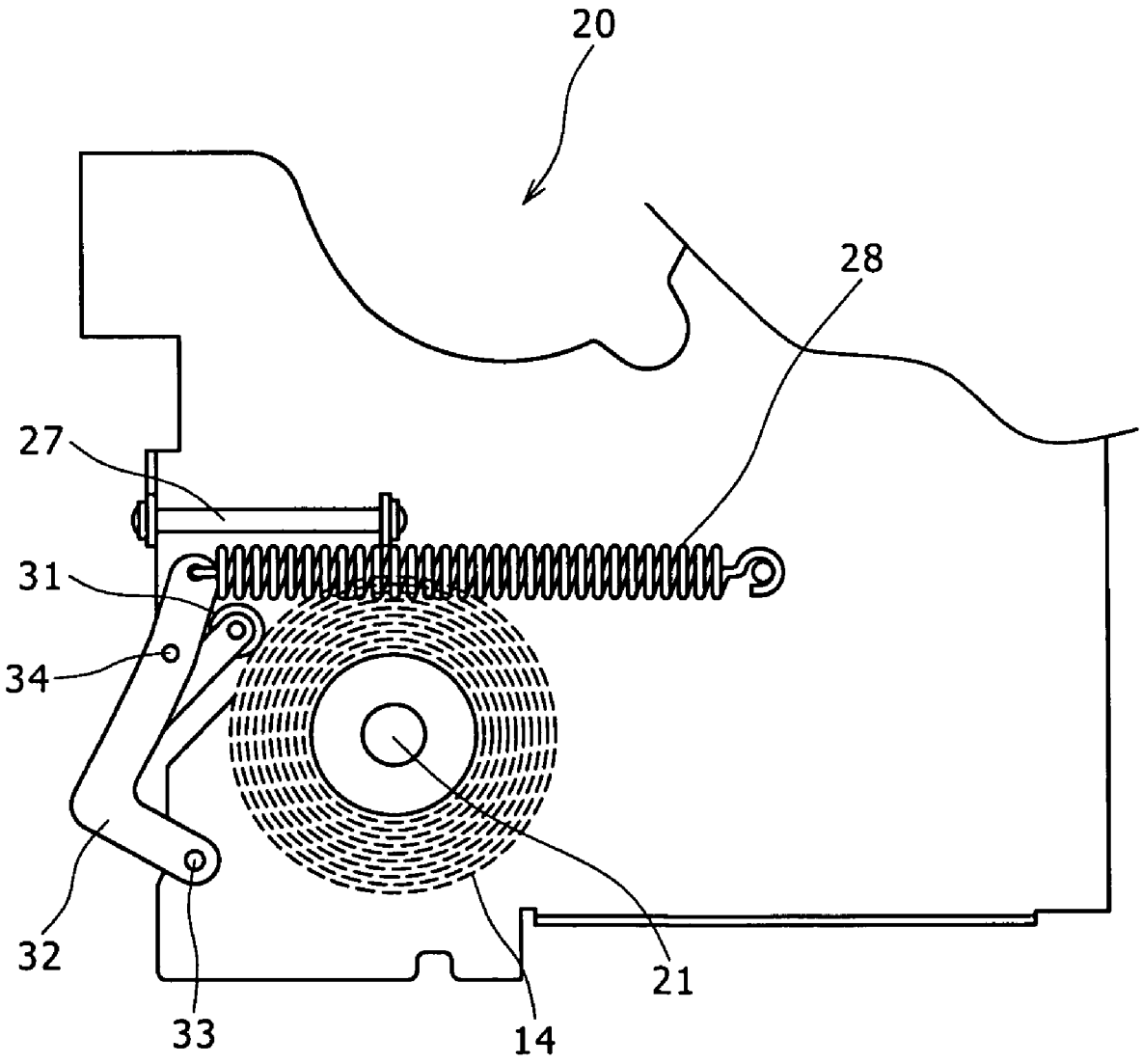
FIG. 7 is a side elevational view showing the ink ribbon transport apparatus of FIG. 3 with the pressing plate, a brake plate and a rotational plate removed.

FIG. 5 shows the ink ribbon transport apparatus 20 of the present embodiment. FIG. 6 shows the ink ribbon transport apparatus 20 shown in FIG. 5 but in a state wherein the pressing plate 25 is removed, and FIG. 7 shows the ink ribbon transport apparatus 20 shown in FIG. 5 but in a state wherein the pressing plate 25, brake plates 24 and rotational plates 22 are removed. It is to be noted that, in FIG. 6, the brake plates 24 are partly broken so that the friction members 23 can be observed.

As seen in FIGS. 5 and 6, the brake plates 24 of the ink ribbon transport apparatus 20 are mounted for movement in a radial direction with respect to the rotational plates 22. In particular, the brake plates 24 are mounted for movement along an axis of the guide member 27 attached in a radial direction to the rotational plates 22. Further, the brake plates 24 are biased by a guide biasing member 28 in the form of a tension spring toward the center of rotation of the rotational plates 22. Therefore, the friction members 23 adhered to the brake plates 24 can slidably move on the rotational plates 22 within a range from an outer circumference to an inner circumference of the rotational plates 22 together with movement of the brake plates 24, and the rotational torque of the rotational plates 22 can be varied thereby.

The ink ribbon transport apparatus 20 includes a winding diameter detection section for detecting the winding diameter of the ink ribbon 14. Referring to FIG. 3, the winding diameter detection section includes a roller 31 for contacting with an outer periphery of the ink ribbon 14 wound on the supply spool 16, and a sensor arm 32 for holding the roller 31 thereon. Then, the brake plates 24 are interlinked with the sensor arm 32. Therefore, as the winding diameter of the ink ribbon 14 decreases as a result of use thereof, the brake plates 24 move from the outer periphery side toward the inner periphery side of the rotational plates 22 thereby to keep the back tension to act upon the ink ribbon 14 fixed.

In particular, the sensor arm 32 is a rigid arm whose position is displaced in response to the amount of use of the ink ribbon 14 and has the roller 31 provided at a free end portion thereof. The roller 31 contacts with an outer peripheral face of the ink ribbon 14 and rocks the sensor arm 32 around a fulcrum 33 in response to the variation of the outer diametrical dimension as seen in FIG. 7.

Further, the sensor arm 32 is biased by the guide biasing member 28 attached directly thereto so that the roller 31 normally contacts with and presses the outer peripheral face of the ink ribbon 14. Therefore, the sensor arm 32 can react accurately in response the variation of the outer diametrical dimension of the ink ribbon 14. Further, the brake plates 24 are connected to the sensor arm 32 through a positioning pin 34 of the sensor arm 32 as seen in FIG. 6 such that the moved position thereof is determined in response to the movement of the sensor arm 32.

Then, when the sensor arm 32 is gradually rocked to the inner circumference side of the ink ribbon 14 as the ink ribbon 14 is used and consumed, the brake plates 24 move toward the center of rotation of the rotational plates 22 by indirect action of the guide biasing member 28 through the positioning pin 34 so that the friction members 23 slidably contact with a portion of the rotational plates 22 which has a decreasing diameter. Accordingly, at whichever position on the rotational plates 22 the brake plates 24 are positioned (irrespective of whether the brake plates 24 are positioned on the outer periphery side or the inner periphery side), normally fixed braking force can be applied to the rotational plates 22.

This is described more particularly. Where the diameter of the ink ribbon 14 is represented by D, the distance of the brake plates 24 from the center of the rotational plates 22 (distance between the acting point of the frictional force by the friction members 23 and the center of rotation of the rotational plates 22) by L, the force of friction acting upon the rotational plates 22 from the friction members 23 to which the brake plates 24 are adhered, and the ribbon tension acting upon the ink ribbon 14 by takeup of the takeup spool 15 by T, the torque acting upon the rotational plates 22 (supply spool 16 rotating integrally with the rotational plates 22) from the brake plates 24 is given by F-L and the torque exerted by the ribbon tension T and acting upon the supply spool 16 is T·D/2. Therefore, $$F \cdot L = T \cdot D/2$$

is satisfied.

Therefore, $$T = (F \cdot L)/(D/2) \quad (1)$$

is derived.

Further, the relationship between the diameter D of the ink ribbon 14 and the distance L of the brake plates 24 from the center of the rotational plates 22 can be represented using a constant k as $$L = k \cdot D \quad (2)$$

because the position of the brake plates 24 is determined in a mechanically linked relationship with the sensor arm 32 as seen in FIG. 6.

Therefore, by substituting the expression (2) into the expression (1), $$T = (F \cdot k \cdot D)/(D/2) = 2 \cdot F \cdot k \quad (3)$$

is obtained.

In the expression (3) above, k is a constant, and the frictional force F is fixed force which depends upon the pressing force of the friction members 23 corresponding to the tensile force (fixed) of the pressing biasing member 26 and the coefficient of friction of the friction members 23 as described hereinabove.

Accordingly, it can be recognized that the ribbon tension T has a normally fixed value irrespective of the diameter D of the ink ribbon. In other words, even if the winding diameter of the ink ribbon 14 varies after use of the ink ribbon 14 is started until the ink ribbon 14 is used up, with the ink ribbon transport apparatus 20 in the printer 1 of the present embodiment, the uniform ribbon tension T can be maintained at any time in response to the variation of the winding diameter of the ink ribbon 14. In other words, the braking force acting upon the rotational plates 22 from the brake plates 24 is fixed, and the back tension acting upon the ink ribbon 14 does not vary after an initial stage after use of the ink ribbon 14 is started until the use comes to an end (after the ink ribbon 14 is used up).

Figure 8:
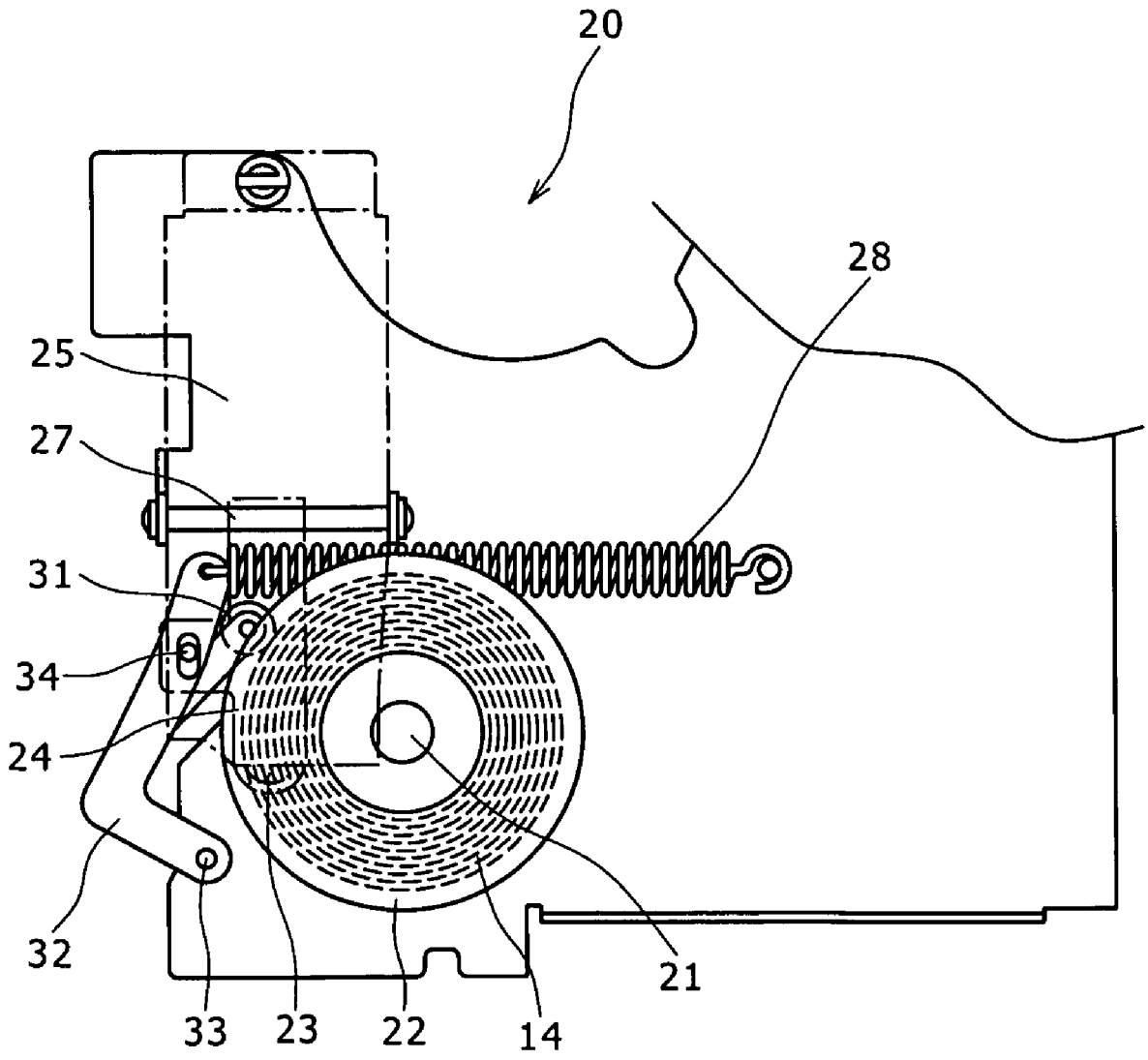
FIG. 8 is a side elevational view showing the ink ribbon transport apparatus of FIG. 3 and illustrating the position of the brake plate which depends upon the winding diameter of the ink ribbon in a state wherein a short period of time elapses after use of the ink ribbon is started.
Figure 9:
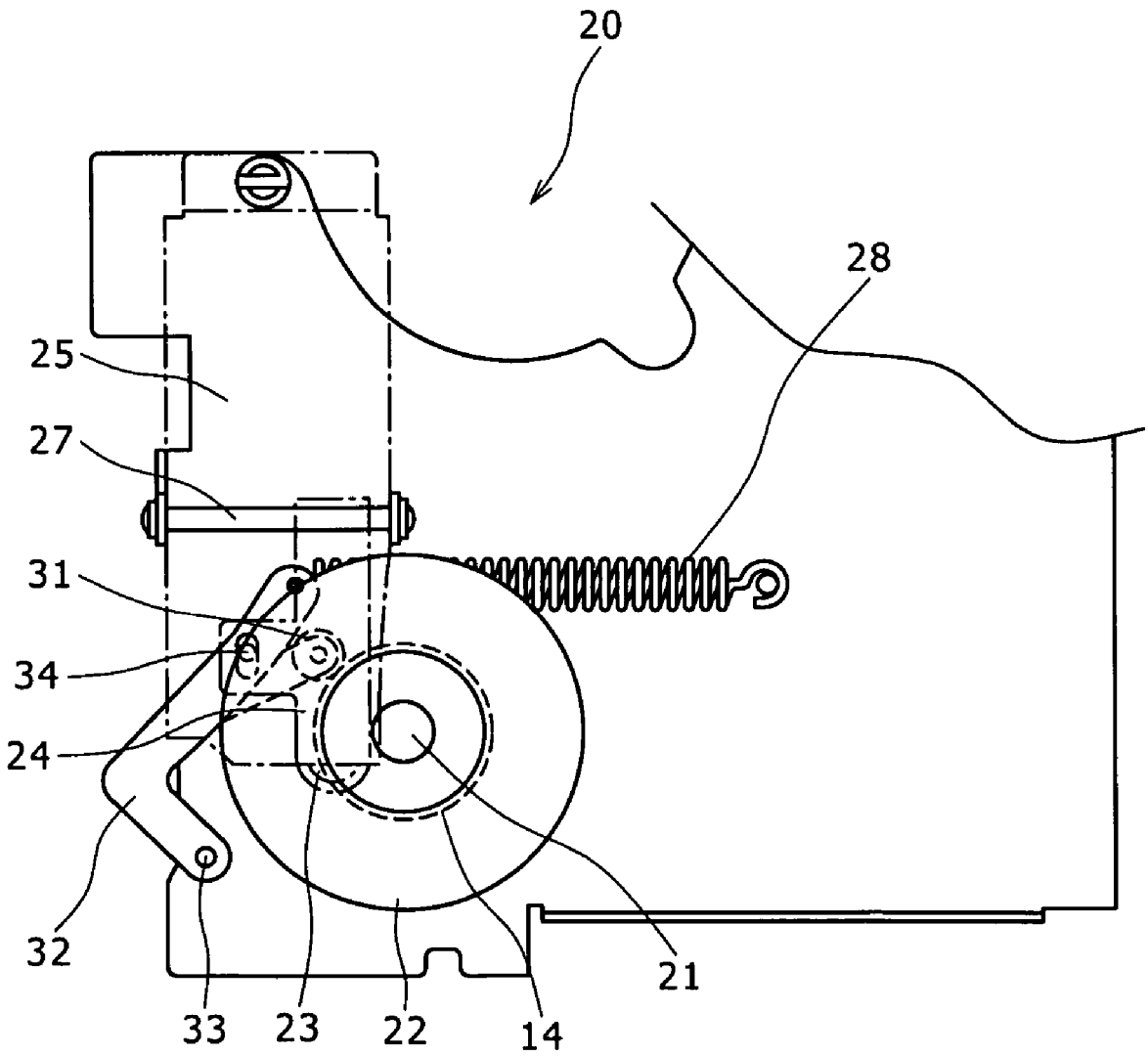
FIG. 9 is a side elevational view showing the ink ribbon transport apparatus of FIG. 3 and illustrating the position of the brake plate which depends upon the winding diameter of the ink ribbon in another state wherein the ink ribbon is going to be used up soon.

FIGS. 8 and 9 illustrate operation states of the ink ribbon transport apparatus 20 and particularly illustrate the position of the brake plates 24 in response to the winding diameter of the ink ribbon 14. In particular, FIG. 8 illustrates a state wherein not a long period of time elapses after use of the ink ribbon 14 is started and the brake plates 24 are positioned on the outermost circumference of the rotational plates 22. In contrast, FIG. 9 illustrates another state wherein the ink ribbon 14 is going to be used up soon and the brake plates 24 are positioned on the innermost circumference of the rotational plates 22. It is to be noted that, in FIGS. 8 and 9, the pressing plate 25 and the brake plates 24 are each indicated by an alternate long and short dash line such that rocking motion of the sensor arm 32 can be observed.

In a state wherein not a long period of time elapses after use of the ink ribbon 14 is started (in a state wherein the diameter of the ink ribbon 14 is comparatively large) as seen in FIG. 8, since the roller 31 pressed against the outer peripheral face of the ink ribbon 14 by the guide biasing member 28 is positioned far away from the center of the rotational plates 22, also the position of the brake plates 24 connected through the positioning pin 34 of the sensor arm 32 is spaced far away from the center of the rotational plates 22. Therefore, the distance of the brake plates 24 from the center of the rotational plates 22 (distance between the center of action of the frictional force by the friction members 23 and the center of rotation of the rotational plates 22) is great. Accordingly, although the torque by the ribbon tension of the ink ribbon 14 is high, also the torque acting upon the rotational plates 22 from the brake plates 24 is high in response to the high torque.

On the other hand, when another state in which the ink ribbon 14 is going to be used up soon (state wherein the diameter of the ink ribbon 14 is comparatively small) is entered, the roller 31 is moved toward the center of the rotational plates 22 by the guide biasing member 28 and the brake plates 24 are moved along the axis of the guide member 27 through the sensor arm 32 toward the center of rotation of the rotational plates 22 thereby decrease the distance of the brake plates 24 from the center of the rotational plates 22. Accordingly, the torque by the ribbon tension of the ink ribbon 14 decreases. However, since also the torque acting upon the rotational plates 22 from the brake plates 24 decreases in accordance with the decrease of the torque by the ribbon tension, the back tension which acts upon the ink ribbon 14 does not change from that shown in FIG. 8.

Since the ink ribbon transport apparatus 20 of the printer 1 of the present embodiment is configured such that the sensor arm 32 which follows up the winding diameter of the ink ribbon 14 and the brake plates 24 which apply braking force to the supply spool 16 are mechanically interlinked with each other, even if the winding diameter of the ink ribbon 14 varies after use of the ink ribbon 14 is started until the ink ribbon 14 is used up, uniform and fixed ribbon tension can be maintained at any time in response to the variation of the winding diameter. Therefore, the print quality of the printer 1 can be stabilized.

Further, the prior art apparatus wherein the spring biasing force upon the clamping member is changed in response to the winding diameter of the ink ribbon to adjust the frictional force or the like requires difficult control although the apparatus has a large scale, and besides is inefficient. In contrast, the ink ribbon transport apparatus 20 of the printer 1 of the present embodiment is structured such that the braking force applied to the rotational plates 22 is fixed at whichever position the brake plates 24 which are movable in a radial direction of the rotational plates 22 are, the ink ribbon transport apparatus 20 can control the ribbon tension geometrically. Accordingly, only if the position of the brake plates 24 with respect to the winding diameter of the ink ribbon 14 is controlled, then accurate movement can be anticipated, and therefore, the rotational torque can be adjusted simply and with certainty. Furthermore, since the ink ribbon transport apparatus 20 does not include a mechanism provided for every ink ribbon cassette, attention can be paid to the cost and the environmental situation from production till abandonment.

While the present invention has been described in connection with the preferred embodiment thereof, the present invention is not limited to the embodiment described above but allows various modifications such as, for example, those described below.

1. In the embodiment described above, the two rotational plates 22A and 22B are used, and the opposite left and right faces of the rotational plates 22A and 22B are sandwiched by the friction members 23A to 23D using the three brake plates 24A to 24C. However, the number of such rotational plates and so forth is not limited to them but can be determined suitably taking the magnitude of the back tension to be applied to the ink ribbon 14 and so forth into consideration.

2. While, in the embodiment described above, a felt is used for the friction members 23A to 23D, some other material may be used instead. Further, the adhered positions or the areas of the felts may be equal to each other or different from each other and may have different coefficients of friction from each other. Further, while, in the embodiment described above, a tension spring is used for the pressing biasing member 26 and the guide biasing member 28, some other resilient member may be used instead.

3. While, in the embodiment described above, the guide biasing member 28 is attached to the sensor arm 32 and the brake plates 24 are biased indirectly through the positioning pin 34 of the sensor arm 32 toward the center of rotation of the rotational plates 22, the guide biasing member 28 may otherwise be attached directly to the brake plates 24. It is to be noted that, in this instance, the roller 31 may contact with the outer peripheral face of the ink ribbon 14 under biasing force exerted by an additionally provided biasing member or making use of the guide biasing member 28 attached to the brake plates 24.

4. While, in the embodiment described above, the ribbon tension (back tension) of the ink ribbon 14 is controlled to a fixed level, the ribbon tension may otherwise be varied. In this instance, the frictional force of the friction members 23 can be varied by adjusting the tensile force of the pressing biasing member 26.

5. While, in the embodiment described above, the rotational torque adjustment apparatus of the present invention is applied to the ink ribbon transport apparatus 20, the application of the rotational toque adjustment apparatus is not limited to this. For example, the rotational torque adjustment apparatus of the present invention can be applied widely to those apparatus which require adjustment of the rotational torque and can be applied, for example, to a transport apparatus for roll paper used in a printer and so forth.

What is claimed is:

1. A rotational torque adjustment apparatus for adjusting rotational torque of a rotational member secured to a rotational shaft for integrally rotating with said rotational shaft, comprising:

a friction member for contacting with said rotational member to apply a frictional load to said rotational member;

a brake member for holding said friction member thereon;

a pressing member for pressing said friction member held on said brake member with a predetermined pressure against said rotational member; and a guide section for holding said brake member for movement thereon;

said brake member being moved in a radial direction of said rotational member along said guide section to vary the rotational torque of said rotational member.

2. The rotational torque adjustment apparatus according to claim 1, wherein said pressing member presses said friction member with a fixed pressure against said rotational member.

3. The rotational torque adjustment apparatus according to claim 1, wherein said pressing member includes a pressing plate for moving said brake member toward said rotational member and a pressing biasing member for biasing said pressing member to press said brake member.

4. The rotational torque adjustment apparatus according to claim 1, wherein said guide section includes a guide member for guiding said brake member in a diametrical direction of said rotational member, and a guide biasing member for biasing said brake member toward the center of rotation of said rotational member.

5. An ink ribbon transport apparatus, comprising:

a supply spool connected to a rotational shaft for integrally rotating with said rotational shaft to supply an ink ribbon;

a takeup spool for taking up the ink ribbon;

a friction member for contacting with said supply spool to apply a frictional load to said supply spool;

a brake member for holding said friction member thereon;

a pressing member for pressing said friction member held on said brake member with a predetermined pressure against said supply spool; and a guide member for holding said brake member for movement thereon;

said brake member being moved in a radial direction of said supply spool by said guide member to vary the rotational torque of said supply spool.

6. The ink ribbon transport apparatus according to claim 5, wherein said pressing member applies predetermined back tension to the ink ribbon through said friction member.

7. The ink ribbon transport apparatus according to claim 5, further comprising a winding diameter detection section for detecting the winding diameter of the ink ribbon wound on said supply spool, said guide member moving said brake member in a radial direction of said supply spool in response to the winding diameter of the ink ribbon detected by said winding diameter detection section.

8. The ink ribbon transport apparatus according to claim 7, wherein, as the winding diameter of the ink ribbon detected by said winding diameter detection section decreases, said brake member moves toward the center of rotation of said supply spool thereby to apply fixed back tension to the ink ribbon.

9. The ink ribbon transport apparatus according to claim 7, wherein said winding diameter detection section includes a roller for contacting with an outer periphery of the ink ribbon wound on said supply spool and a sensor arm for holding said roller thereon, and said brake member moves in an interlinked relationship with said sensor arm.

10. A printer, comprising:

an ink ribbon transport apparatus including a supply spool connected to a rotational shaft for integrally rotating with said rotational shaft to supply an ink ribbon for printing toward a head and a takeup spool for taking up the ink ribbon;

said ink ribbon transport apparatus further including a friction member for contacting with said supply spool to apply a frictional load to said supply spool, a brake member for holding said friction member thereon, a pressing member for pressing said friction member held on said brake member with a predetermined pressure against said supply spool, and a guide member for holding said brake member for movement thereon;

said brake member being moved in a radial direction of said supply spool by said guide member to vary the rotational torque of said supply spool.

* * * * *